US006708354B1

(12) United States Patent
Carter et al.

(10) Patent No.: US 6,708,354 B1
(45) Date of Patent: Mar. 23, 2004

(54) ADJUSTABLE WRAP FOR PILLOW USED FOR SUPPORTING BABY WHEN NURSING

(76) Inventors: Matthew Carter, 113 Penn St., Greenville, SC (US) 29605; Trudi Carter, 113 Penn St., Greenville, SC (US) 29605

( * ) Notice: Subject to any disclaimer, the term of this patent is extended or adjusted under 35 U.S.C. 154(b) by 0 days.

(21) Appl. No.: 10/382,012

(22) Filed: Mar. 5, 2003

Related U.S. Application Data

(60) Provisional application No. 60/362,277, filed on Mar. 7, 2002.

(51) Int. Cl.[7] ..... A47G 9/00; A47D 13/00

(52) U.S. Cl. ..... 5/632; 5/655; 128/845

(58) Field of Search ..... 5/632, 655, 630; 128/845

(56) References Cited

U.S. PATENT DOCUMENTS 4,173,048 A * 11/1979 Varaney ..... 5/632
4,383,713 A 5/1983 Roston
5,027,457 A 7/1991 Sweet
5,029,351 A 7/1991 Weber
5,092,005 A 3/1992 Byrn
5,133,098 A 7/1992 Weber
5,154,649 A 10/1992 Pender
5,159,727 A 11/1992 McCracken
5,184,796 A 2/1993 Maher
5,519,906 A 5/1996 Fanto-Chan
5,551,109 A 9/1996 Tingley et al.
5,581,833 A 12/1996 Zenoff
5,664,828 A 9/1997 Simon
5,790,999 A 8/1998 Clark
5,815,863 A * 10/1998 Dolisi ..... 5/632
5,901,375 A 5/1999 Davis
5,978,990 A * 11/1999 Akey ..... 5/632
6,088,854 A * 7/2000 Brownrigg ..... 5/632

* cited by examiner

*Primary Examiner*—Alexander Grosz
(74) *Attorney, Agent, or Firm*—J. Herbert O'Toole; Nexsen Pruet, LLC

(57) ABSTRACT

An assembly of two pillows attached in such a way as to support the back and legs of a mother nursing an infant in a side lying position. The assembly consists of a flat, waterproofed pad attached to a cushioned back supporting pillow connected in turn to a pillow pulled down between the mother's knees. The placement of the second pillow causes tension between the two pillows that helps support the mother's side lying position while nursing.

2 Claims, 3 Drawing Sheets

ADJUSTABLE WRAP FOR PILLOW USED FOR SUPPORTING BABY WHEN NURSING

This application claims the benefit of Provisional application Ser. No. 60/362,277, filed Mar. 7, 2002.

BACKGROUND OF THE INVENTION

This invention is directed to a novel, adjustable water resistant pad and attached pillow wrap that can be wrapped and positioned around a nursing mother in a side lying position, creating tension in the wrap to hold the mother in said side lying position. This relieves upper body back strain on the nursing mother. The water resistant pad or a removable waterproof covering is used to keep the bed linens dry while the baby is nursing.

BACKGROUND AND PRIOR ART

Many mothers breastfeed their babies. Mothers' breast milk has been proven to be more beneficial to nursing babies than artificial milk formulations or cow's milk. The American College of Pediatrics recommends breastfeeding for one year. Often the mother chooses to breastfeed lying down. La Leche League International, an organization that promotes breastfeeding, states in it's manual, "The Womanly Art of Breastfeeding" (1991 ed., p. 53), > "You may be more comfortable breastfeeding your baby lying down . . . You will need to use pillows to support yourself . . . Lean back into the pillows that are behind your back . . . mothers also place a pillow between their knees."

When breastfeeding a baby laying in bed, the mother must lay the baby along her body and hold herself in a side reclining position and bend slightly backwards with the baby's head next to her breast. After feeding at one breast for fifteen to twenty minutes, the mother rolls over and the baby is placed along the mother's other side, and the baby feeds at the other breast for fifteen to twenty minutes.

Usually, the mother must lie on her side and tilt slightly backward away from the baby in order to assist the breastfeeding process. The nursing mother may also bend her knees to alleviate backpressure. These movements force the mother to arch her back backward, and twist to the side slightly while remaining on her side. Holding this static position, while nursing, causes strain on the back of the nursing mother. This can lead to poor posture and subsequent chronic backache problems for the mother. Mothers who have breastfed for many months frequently complain that they have to restructure their muscles and posture in order to carry themselves upright after having nursed a baby for that length of time.

Various patents have been granted for various inventions that relate to breastfeeding.

U.S. Pat. No. 4,383,713, to Roston, granted May 17, 1983, discloses a support apparatus for infants. The apparatus comprises a planar sheet fabricated from a relatively high pile material to which a Velcro fastener can be secured. Located on the planar sheet is a pillow member having a central aperture and a dependent outer flange which angularly slopes towards the central aperture. The bottom surface of the pillow has a central section for accommodating the neck of a child. The underside of the pillow has a Velcro fastener to enable positioning of the same on the surface of the planar member. Also included are left and right lateral support members which are emplaced at the sides of an infant when his head is emplaced within the pillow. The lateral support members also have Velcro backings to enable them to be selectively positioned on the planar sheet.

U.S. Pat. No. 5,027,457, to Sweet, granted Jul. 2, 1991, discloses a pillow having extended arms and legs, the arms being semi-circular and of sufficient length to enable them to extend either around the neck or extend around the torso of a human body and enable the pillow to cling to the body and support the neck or back. The pillow, and/or an external pillow case or removable cover, can be decorated to make the pillow an ornamental design or caricature, as of a person or animal. The cover can simulate an article of clothing and is adapted to permit the arms and legs of to retain their initial appearance.

U.S. Pat. No. 5,029,351, to Weber, granted Jul. 9, 1991, discloses a baby supporter and positioner that can be used by nursing mothers and any other person who wants to hold and interact with a baby on their lap while seated. The baby support pillow is wedge shaped to provide for a slightly inclined positioning of the baby and to provide for better alignment of the baby's head to the mother's breast. The baby support pillow has a contoured side to allow the pillow to cradle the person's body and provide a firm supportive surface close to the person's body for the baby.

U.S. Pat. No. 5,154,649, to Pender, granted Oct. 13, 1992, discloses an inflatable nursing pillow having multiple air chambers which provide adjustability of air pressure and customized support for a child during bottle and breastfeeding. The device is anatomically shaped in a substantially yoke-shaped configuration to extend around the user's torso and provide support for either left-handed or right-handed feeding. Each air chamber has an independent air valve to allow separate adjustment of air pressure. This adjustability allows customized support and adaptation for the size of the child, position of the user and child, and adaptation with chair arms, bed railings, or other physical constraints. The invention includes a removable elastic cover which provides a soft and moisture absorbent outer surface which can be easily changed and washed. The device is fully portable and can be deflated for storage or transportation and folded up into small dimensions for convenient carrying in a handbag or other suitable article.

U.S. Pat. No. 5,159,727, to McCracken, granted Nov. 3, 1992, discloses a child care device including a pillow mounted on a baby blanket intermediate its ends. The ends of the blanket are provided with mating fastening means, one on one side of the blanket, one on the other. The blanket is wrapped around the baby holder's arm so that the pillow is on the upside and the baby's head rests thereon when the baby is being cradled by the baby holder. When the baby falls asleep it may be transferred to a crib mattress without disturbing it by placing its body on the mattress along with the pillow and removing the arm from beneath the pillow. In an alternative embodiment, a sleeve mounting the pillow is utilized in lieu of a blanket.

U.S. Pat. No. 5,184,796, to Maher, granted Feb. 9, 1993, discloses an apparatus which aids in the feeding of a baby while the baby is placed face-up on a substantially planar feeding surface to various levels of a sitting up position of approximately 45° angle. The feeding apparatus is a triangular inflatable support system comprising two straps which encircle the chest under the arms of a baby for securing the entire apparatus to the baby, a strap to secure the bottle to the feeding apparatus and a valve element which inflates and deflates the hollow triangular chamber with air for the purpose of raising or lowering the height of the bottle to control the flow of the liquid into the mouth of the baby for proper feeding. While the primary object of the disclosed invention is for the feeding of a baby, this device also can be used by any person who cannot hold a container because of any physical or mental impairment that would limit one's ability to feed oneself.

U.S. Pat. No. 5,519,906, to Fanto-Chan, granted May 28, 1996, discloses a support pillow that is generally horseshoe or U-shaped with a generally pear-shaped cavity in the center and a means of fastening. When used in a horizontal position, the cavity is large enough to fit around the mid-section of a normal adult thus allowing for a back support with arm rests, a pregnancy pillow, a floor pillow for reading, sleeping or watching TV, or a nursing pillow. When the fastener is employed, the two tubular arms overlap at the ends forming a closed oval or donut shape. In this position, the pillow can support a small child in a sitting or reclining position. The pillow can also be used in a vertical position supporting both upper and lower back of the user. The pillow is filled with a soft pliable material making it extremely comfortable for all ages and because of the fastener, it is easy to carry.

U.S. Pat. No. 5,551,109, to Tingley et al., granted Sep. 3, 1996, discloses a portable pillow for holding and cradling an infant that can be used by any person desiring to hold, feed, or cuddle the infant. The pillow can be held in a person's arms while sitting or standing, lay comfortably on someone's lap, or be placed on a flat surface, cradling the infant, without the need of holding the pillow. There is a recessed surface where the infant is placed, and overlapping straps that snugly hold the infant within the pillow. The straps are adjustable and held in place with fasteners, such a hook and loop. An inner foam core that is removable from the outer cover is made from two layers of foam with different densities. The top layer is soft for comfort while in contrast the bottom layer is firmer for support and structure. The pillow is portable, lightweight, and easy to hold and carry. Therefore it can be used as a portable bed. This will enable the infant to sleep securely and undisturbed, while the pillow is being held or carried.

U.S. Pat. No. 5,581,833, to Zenoff, granted Dec. 10, 1996, discloses a support pillow which has a shape and construction that makes the support pillow particularly useful in situations in which it is necessary or desirable to have a support surface near the body of a user. The support pillow can be securely attached to the body to, for example, aid in supporting a baby during feeding, provide support of the elbows, forearms and wrists while reading or using a keyboard, or provide support for the forearms or external objects while engaging in an activity such as watching television or eating. The support pillow cushions and supports the back, and helps to hold the back in an orthopedically correct position. The support pillow also relieves muscle stress associated with holding a baby or other object by enabling the baby or object to be supported by the pillow. The support pillow is shaped to conform to the user's body and can be adjusted to have a fit of desired tightness so that the pillow remains stably and securely in place on the user (even when the user is standing or moving around), the back support of the pillow is enhanced and the pillow fits comfortably on the wearer.

U.S. Pat. No. 5,664,828, to Simon, granted Sep. 9, 1997, discloses a device for support of two infants for simultaneous feeding thereof by a sole user and includes a rigid platform disposed on arms of a chair in which the user of the device is seated. A cushion is disposed on the rigid platform upon which the infants are supported for simultaneous feeding by the user of the device.

U.S. Pat. No. 5,790,999, to Clark, granted Aug. 11, 1998, discloses a nursing pillow adapted for use with twins that can be used by anyone wishing to breastfeed or bottle-feed one baby, or two babies simultaneously. The design of the nursing pillow is generally a squared U-shape with symmetrical sides of equal length and firmness to accommodate the heads and bodies of two babies at once. The pillow can support growing babies from birth to two years old, or up to 70 pounds of total baby weight. The nursing surface preferably has an inwardly-angled slope so babies roll naturally and safety towards the user. A detachable back pillow may be included to provide lower and mid-back support for the user.

U.S. Pat. No. 5,901,375, to Davis, granted May 11, 1999, discloses a multi-purpose garment which has an elongated, rectangular first sheet. The first sheet has an inside surface, an outside surface, a pair of short sides and a pair of long sides. A hood has a bottom edge attached at a central position along one of the long sides of the first sheet. A first pocket is disposed on the inside of the first sheet and opens towards the hood at a central position along the one long side of the first sheet. The first pocket is positioned and sized to receive the hood folded therein. A reversible second pocket is disposed on the outside of the first sheet and opens away from the hood at a central position along the one long side of the first sheet and the second pocket is sized to receive the first sheet folded therein.

U.S. Pat. No. 5,154,649 to Pender granted Oct. 13, 1992 offers an inflatable nursing pillow with multiple adjustable air chambers for customized support during nursing. The three pillows mentioned above provide a generally flat nursing surface and lack back support for the user.

Other nursing pillows focus on supporting the arm of the mother, which in turn supports the head and body of one baby, such as U.S. Pat. No. 5,133,098 to Weber granted Jul. 28, 1992. This pillow is wedge-shaped to provide an inclined position for one baby laterally across mother's lap.

Two other pillows were cited that have recessed areas for the nursing infant, U.S. Pat. No. 5,551,109 to Tingley granted Sep. 03, 1996 offers a pillow that the mother cradles in her arm which has a generally flat recessed surface area and overlapping straps which hold the infant in place. Also, U.S. Pat. No. 5,092,005 to Byrn granted Mar. 03, 1992 provides a depression in the center of the pillow for the baby to lay within. However, the configuration and size of these pillows would not accommodate two babies and there is no back support pillow for the user.

All of the existing pillows described above suffer from the disadvantage that they are solely intended to be used in a seated or standing position. None are specific for or readily adaptable to the reclined feeding position as described by the Le Leche League Manual.

SUMMARY OF THE INVENTION

The invention is directed to a pillow wrap for nursing mothers comprised of (a) a waterproofed pad to be laid on by both the mother and the nursing infant; (b) padded support pillow sized to support the mother's back attached to the waterproofed pad; (c) a length of fabric attached to the support pillow to wrap over the mother's hip; (d) a second pillow attached to the second fabric length to be pulled down between the mother's knees and thighs, while relieving stress on the hips. The wrap and second pillow cause tension to keep the mother in the side lying position. The wrap may be constructed of washable durable cloth and a water resisted fabric, laminated together. The padding upon which mother and infant lie is formed of a waterproof or resistant fabric or covered with a waterproof cover. The tension of the second fabric length can be adjusted by pulling the second pillow farther down between the knees of the mother. The adjustment of the second pillow will also accommodate mothers of differing heights and girths.

BRIEF DESCRIPTION OF DRAWINGS

In drawings which illustrate specific embodiments of the invention, but which should not be construed as restricting the spirit or scope of the invention in any way.

DETAILED DESCRIPTION

Figure 1:
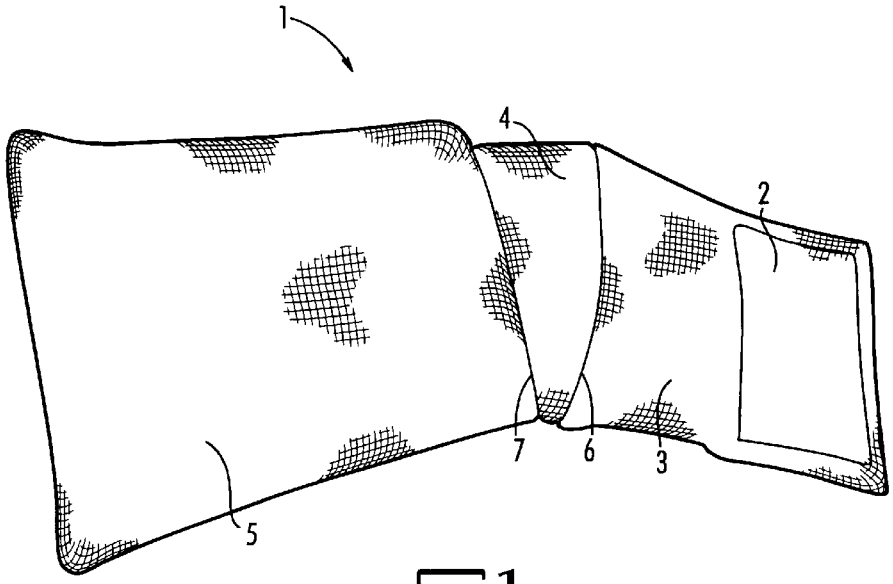
FIG. 1 illustrates a top view of the pillow wrap according to the invention.

Referring to the drawings, FIG. 1 illustrates a top view of the pillow wrap according to the invention. As seen in FIG. 1, the pillow wrap is constructed of a waterproofed pad 2 attached to a rectangular cushioned body 3, attached to a slightly curved fabric or trapezoidal length 4 attached to a second larger rectangular cushioned body 5. The pillow wrap is constructed of a suitable soft cloth, preferably flannelette or some other soft cloth, on parts 3, 4, and 5, and a waterproof or water resistant backed cloth on pad 2. Alternatively, pad 2 may be covered with a removable waterproof pad or a diaper material with an absorbent top surface and a waterproof backing pad. The seams 6 and 7 should be reinforced to stand up to a certain amount of tension on the fabric. Fabric length 4 may be rectangular or may have one short side (trapezoidal) to achieve proper angularity as will be discussed below.

The pillow wrap 1 according to the invention, by creating tension between the two rectangular bodies 3 and 5, alleviates deep pressure to the small back muscles, which end to become easily fatigued. Progressive weakness in muscle strength and muscle soreness can be avoided or minimized by the application of tension support to the affected area. The mother may stimulate back and leg muscles isometrically while reclined. The separation of the knees also helps to relieve lower back strain.

Figure 2:
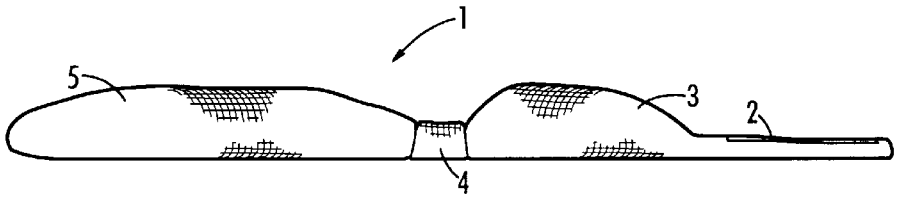
FIG. 2 illustrates a side view of the pillow wrap according to the invention.

FIG. 2 illustrates a side view of the pillow wrap 1, including the waterproofed pad 2 attached to a cushioned rectangular body 3, attached to a slightly trapezoidal fabric length 4 attached to a second larger cushioned rectangular body 5. FIG. 2 also demonstrates the relative thickness differences in the portions of the wrap.

Figure 3:
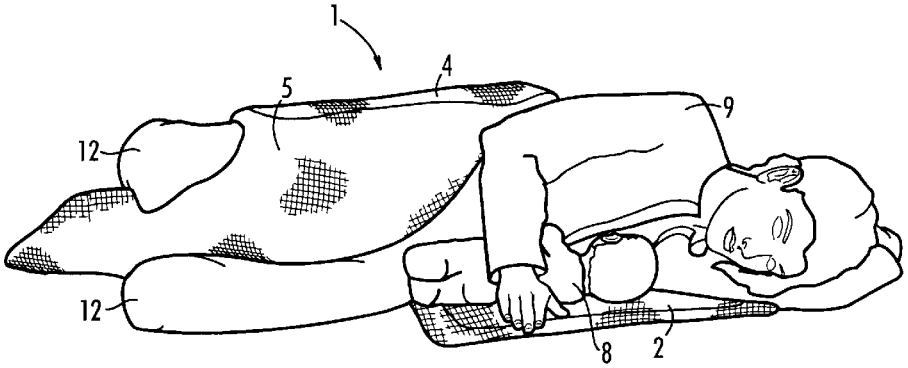
FIG. 3 illustrates a front view of a mother with a baby resting on the attached water proofed fabric pad and the pillow wrap coming over her hip with the attached second pillow held between her knees.

FIG. 3 illustrates a front view of a nursing mother 9 with the pillow wrap 1 according to the invention with a baby 8 resting on the pillow wrap. As seen in FIG. 3, the baby rests on the waterproofed pad 2 in front of the nursing mother 9 who is also laying on the waterproofed pad 2. The second fabric length 4 is seen wrapping around the hip and small of the back of the nursing mother 9. The attached second pillow 5 is also seen held between the nursing mother's knees 12.

Figure 4:
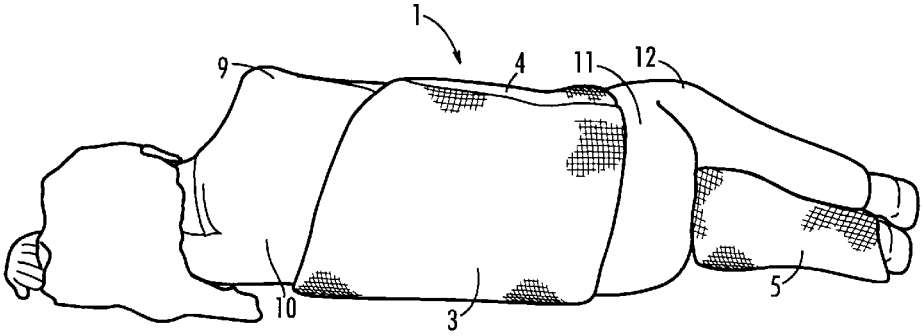
FIG. 4 illustrates a rear view of a mother with the pillow wrap pad around the back according to the invention and the second pillow held between her knees.

FIG. 4 illustrates a rear view of a nursing mother 9 with the pillow wrap 1 according to the invention. As seen in FIG. 4, the first rectangular padded pillow 3 wraps along the back 10 of the nursing mother 9. The second length of fabric 4 is seen wrapping up and over the hip 11 of the nursing mother 9. The attached second pillow 5 is also seen held between the nursing mother's knees 12.

Figure 5:
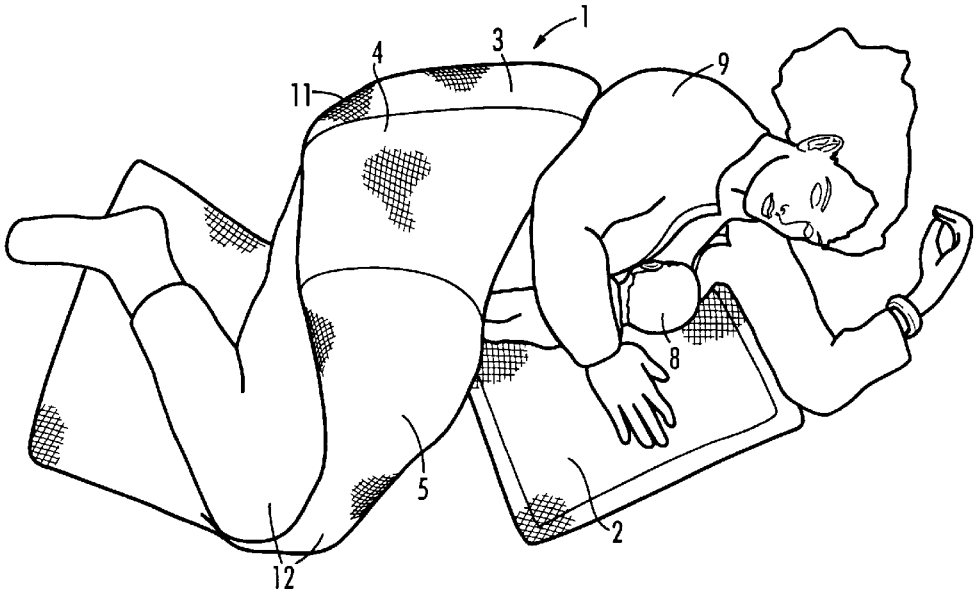
FIG. 5 illustrates a top view of a mother with the pillow wrap pad around the back according to the invention and the second supporting pillow held between her baby resting on the attached water proofed fabric pad.

FIG. 5 illustrates a top view of a nursing mother 9 with the pillow wrap 1 according to the invention with a baby 8 also resting on the waterproofed pad 2. As seen in FIG. 5, the rectangular body 3 pulls against the nursing mother's back. The second length of fabric 4 is seen wrapping up and over the hip 11 of the nursing mother 9. And finally the attached second pillow 5 is also seen held between the nursing mother's knees 12.

The pillow wrap according to the invention assists nursing mothers in the side lying breastfeeding process and absorbs some of the strain on the mother's back. The pillow wrap is readily portable. The position of the mother is static, a position which the mother must endure for periods of fifteen to thirty minutes per breast. The pillow wrap helps support the mother so that the back of the mother does not have to carry all of the static pressure of maintaining the position. The mother may stretch isometrically without changing orientation. It also assists the mother in adopting the proper relationship to the baby for the most efficient breastfeeding process.

The pillow wrap has other uses as well. In addition to assisting nursing mothers, it may also be used by a pregnant woman to reduce strain and maximize comfort when the size of the woman's abdomen requires lying on a side while sleeping. Sleeping on her back is not recommended by doctors due to the cut off of blood flow to the uterus and fetus from m uterine pressure on the vena cava.

The pillow wrap according to the invention is also extremely helpful to anyone who has a medical need to maintain a side lying position.

As will be apparent to those skilled in the art in the light of the foregoing disclosure, many alterations and modifications are possible in the practice of this invention without departing from the spirit or scope thereof. Accordingly, the scope of the invention is to be construed in accordance with the foregoing claims and not the foregoing detailed description.

What is claimed:

1. A pillow wrap (1) for nursing mothers comprising:

(a) a waterproof pad (2) to be laid on by the mother and the nursing infant;

(b) a padded support pillow (3) sized to support the mother's back attached to said pad;

(c) a length of fabric (4) connected to said pillow to wrap over the mother's hip; and (d) a second pillow (5) attached to the length of fabric to be drawn between the mother's knees and thighs causing tension in the fabric length.

2. A pillow wrap (1) according to claim 1 wherein said waterproof pad (2) further comprises a detachable waterproof sheet which may be removed for cleaning.

* * * * *